US007587866B1

(12) United States Patent
Perkins

(10) Patent No.: US 7,587,866 B1
(45) Date of Patent: Sep. 15, 2009

(54) INTEGRATED HOUSING SYSTEM ACTIVATED BY THE ACTION OF A PULL DOWN STAIRWAY

(76) Inventor: Donald Burgess Perkins, 44 Indian Rock Rd., Nashua, NH (US) 03063

( * ) Notice: Subject to any disclaimer, the term of this patent is extended or adjusted under 35 U.S.C. 154(b) by 687 days.

(21) Appl. No.: 11/090,742

(22) Filed: Mar. 25, 2005

Related U.S. Application Data

(60) Provisional application No. 60/556,997, filed on Mar. 26, 2004.

(51) Int. Cl.
*E04F 11/00* (2006.01)
*E04F 19/10* (2006.01)
*E06C 9/00* (2006.01)

(52) U.S. Cl. ..... 52/183; 52/181; 52/186; 182/78; 182/79; 182/81

(58) Field of Classification Search ..... 52/182, 52/183, 186; 182/77, 78, 79, 80, 81
See application file for complete search history.

(56) References Cited

U.S. PATENT DOCUMENTS 3,807,528 A * 4/1974 Frank ..... 182/81
4,151,894 A 5/1979 Edwards
4,299,059 A * 11/1981 Smith ..... 49/401
4,541,208 A 9/1985 Vesperman et al.
4,563,845 A 1/1986 Stipe
4,658,555 A 4/1987 Steiner
4,928,441 A 5/1990 Daley
5,220,757 A 6/1993 Hulligan
5,271,198 A 12/1993 Freeman
5,475,955 A 12/1995 Dickinson
5,867,946 A 2/1999 Seagren
2002/0112409 A1 * 8/2002 Knowles ..... 52/19

* cited by examiner

*Primary Examiner*—Brian E Glessner
*Assistant Examiner*—Branon C Painter

(57) ABSTRACT

An integrated insulated housing system with handrails and a system of seals for a pull down stairway opening is provided. The integrated housing system reduces air convection, moisture loss and dirt infiltration. The insulation of the housing system reduces heat loss. Handrails as part of the system are deployed by the action of the pull down stairway. No manual intervention is required. As the stairway is pulled down for use, the integrated housing above moves away from the access opening. Simultaneously, the two integrated handrails move into a stable position on the upper floor and to either side of the stairway. As the stairway is returned up to its closed position, the connected insulated housing moves back into position sealing the access opening.

19 Claims, 3 Drawing Sheets

INTEGRATED HOUSING SYSTEM ACTIVATED BY THE ACTION OF A PULL DOWN STAIRWAY

CROSS-REFERENCE TO RELATED APPLICATION

This application claims the benefit under 35 U.S.C. § 119 (e) of U.S. provisional application Ser. No. 60/556,997, filed Mar. 26, 2004. The aforementioned provisional application is incorporated by reference in its entirety.

BACKGROUND OF THE INVENTION

The current invention is in the field of home improvement and home construction and more particularly, relates to a cover or housing system which may be integrated with a pull down stairway. The present invention addresses certain problems associated with access to an upper floor using a pull down stairway. In a further aspect, the present invention provides an improved method of access to and exit from an upper room such as an attic using an installed folding stairway.

There are various inventions that cover, insulate, or attempt to seal the opening above a pull down stairway. Pull down stairways are notorious for their inefficiency with loss of warm air and moisture up through the stairway access. Previous devices made of foam or fiberglass enclosures must be manually removed when access is needed and re-positioned manually while climbing back down the stairway or standing on a ladder. Other devices attempt to reduce the infiltration of warm air, but lack the insulation R-value recommended by the building industry. Other inventions are designed as trap door devices, but still require manual intervention.

The preferred embodiments of the present invention address air, moisture and dust infiltration and thermal loss associated with access through an upper floor opening using a folding or pull down stairway while also providing a handrail, positioned to be grasped by a user when the pull down stairway is deployed for assisting the user when entering and leaving the upper floor opening.

SUMMARY OF THE INVENTION

According to the invention, the integrated housing system is physically attached to and is activated by the up and down motion of the separately installed pull down stairway.

In one aspect of the invention, an integrated system activated by the action of a pull down stairway is provided. One or more handrails are deployed making it easy to enter and exit the stairway opening without the need to manually intervene in removing the housing box above the opening. The deployment of the one or more handrails is accomplished when the stairway is pulled down for use. In the preferred embodiments a pair of handrails are deployed, positioned on opposite sides of the upper floor opening; the handrail being pivotally connected to the cover such that in a closed position the handrail extends above the cover.

In another aspect, a highly insulated housing above the pull down stairway is provided that reduces the heat loss of the enclosed access into an upper space that may or may not be heated.

In yet another aspect, a sealed housing over the closed pull down stairway is provided that reduces the passage of warm air and moisture from rising into an upper room that may or may not be heated.

It still another aspect, a housing over the closed pull down stairway is provided that reduces the infiltration of dirt and debris from entering the living space below the pull down stairway opening.

In operation, as the pull down stairway assembly is deployed in a downward direction for use, the integrated housing above the stairway moves away from the access opening. Likewise, when the pull down stairway assembly is returned to its stored position, the housing returns to the closed position and seals the access opening. Unlike prior art stairway covers, additional manual intervention is not required to remove the cover from the opening in the floor above once the stairway has been deployed for use and/or to return the cover to the closed position when the pull down stairway is returned to the stored position.

In certain embodiments, the present invention is embodied in a sliding or rolling configuration wherein the housing rolls back and away from the access opening. In certain other embodiments, the present invention is embodied in a hinged configuration wherein the housing rises or pivots up and away from the access opening.

The activation is accomplished by one or more arms attached to a stairway rail and by one or more adjustable push pull sleeves connected to the one or more arms and a housing extension. The push pull sleeves differ in the two configurations, as described in the detailed description.

BRIEF DESCRIPTION OF THE DRAWINGS

The invention may take form in various components and arrangements of components, and in various steps and arrangements of steps. The drawings, wherein like reference numerals are used for like or analogous components throughout the several views, are only for purposes of illustrating preferred embodiments and are not to be construed as limiting the invention.

DETAILED DESCRIPTION OF THE PREFERRED EMBODIMENTS

Figure 1:
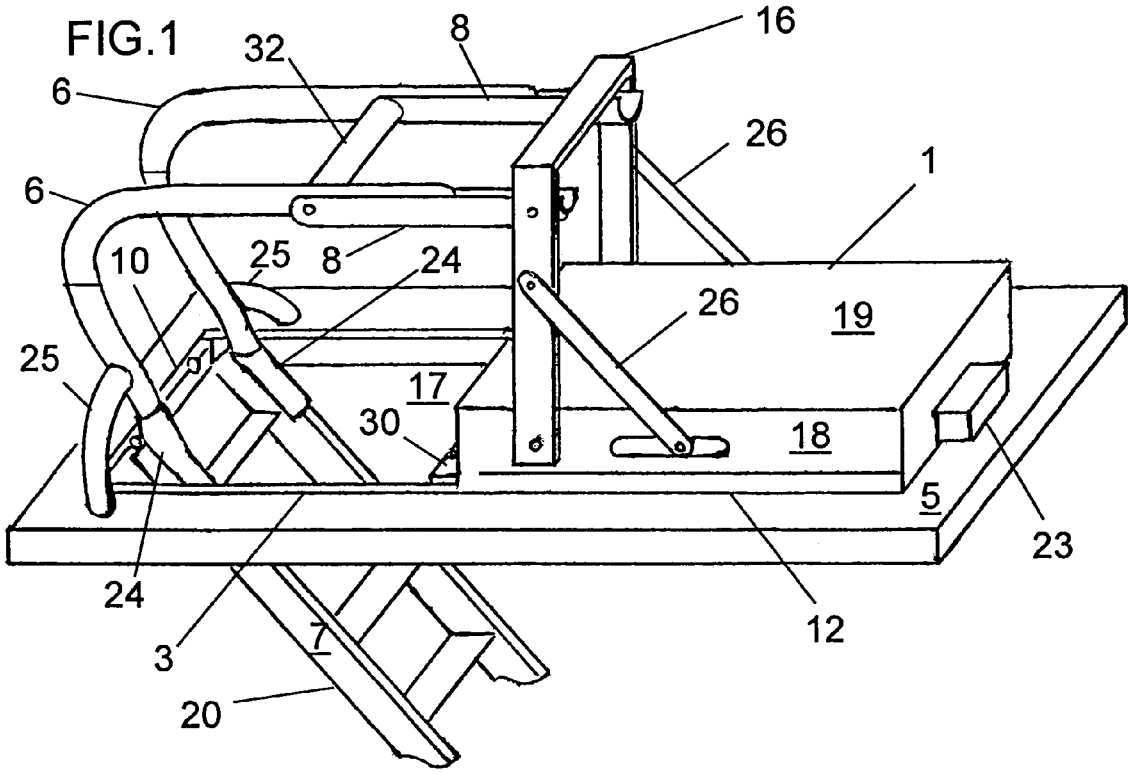
FIG. 1 is a perspective view of the integrated housing system of the sliding configuration and in the opened position.
Figure 2:
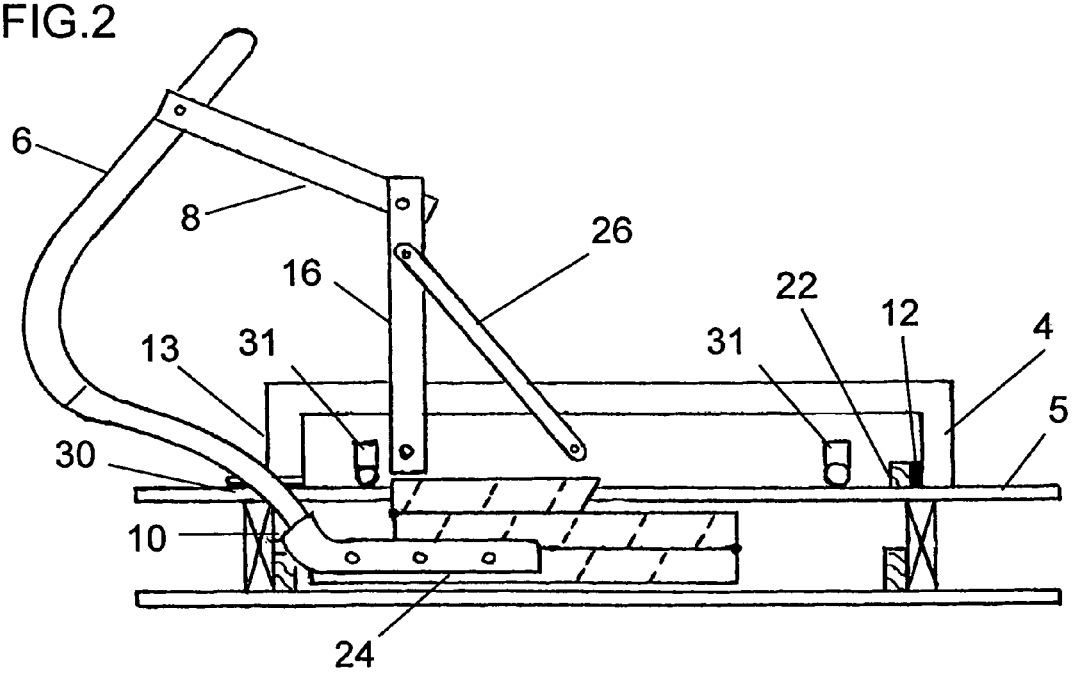
FIG. 2 shows a side view of the air convection seals at the front and back housing panels of the sliding cover configuration in the closed position. The side view also shows the handrail arm and push pull sleeve in the up and closed position. The rollers at the bottom edge of the side panels are shown.
Figure 3:
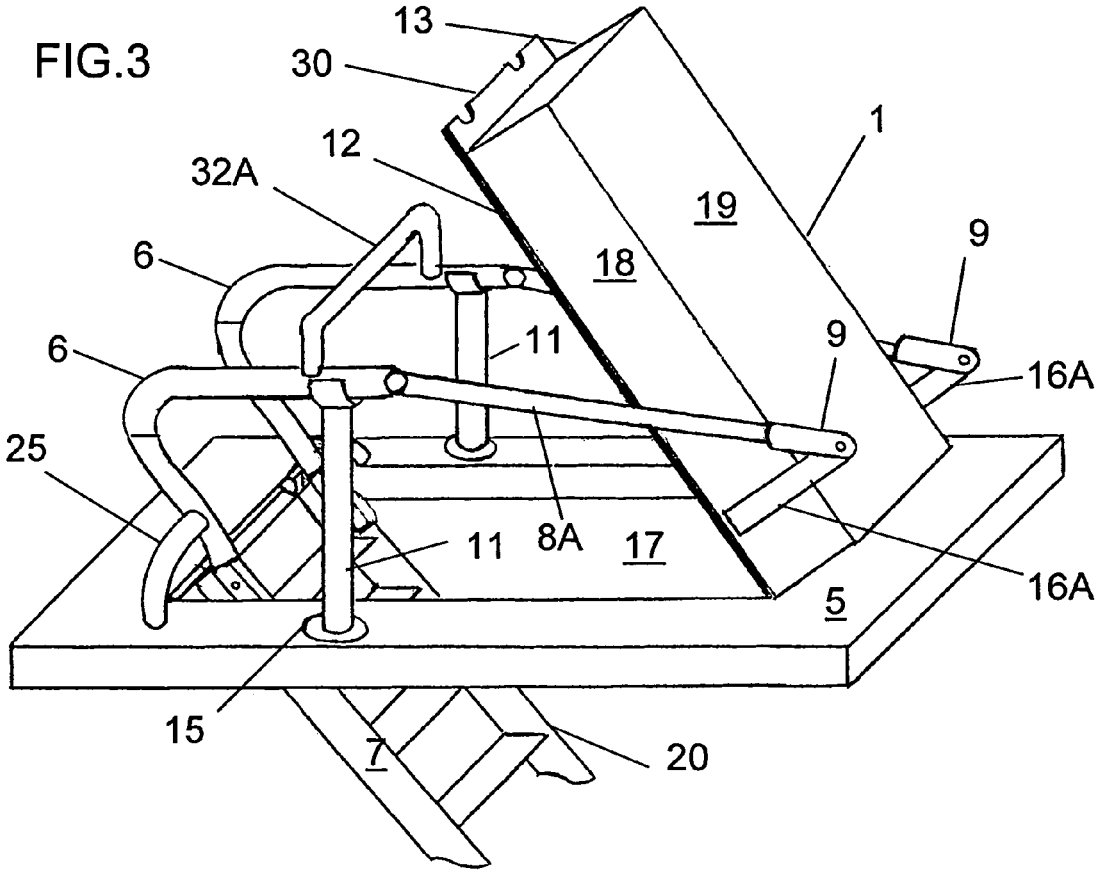
FIG. 3 is a perspective view of the activated insulated housing of the hinged configuration held in the raised or open position by the handrail arms and the push pull sleeves.

The primary components of the current invention are shown in the perspective views of FIGS. 1 and 3. A housing box or cover 1 is provided to selectively cover an opening in a building floor 5 which is accessible via a pull down stairway 7. In a preferred embodiment, the housing box or cover 1 is fitted with insulation, which may be provided in a number of ways. For example, an insulating material may be provided on one or more exterior surfaces of the cover 1 and/or within the interior compartment defined by the housing box 1. Alternatively, the insulating material may encased within the cover shell or the cover 1 may otherwise be formed of a thermally insulating material. The runners 3 in FIG. 1 are attached to the upper floor 5 and are used for guiding the housing box 1 in the sliding configuration of the invention. The two curved arms 6 are pivotally attached to push pull sleeves 8 and function as actuators when the stairway 7 is in motion. The curved arms 6 also preferably act as handrails when the stairway 7 and housing box 1 are fully deployed. The push pull sleeves 8 each hold a respective one of the arms 6 in place for use as handrail when the cover 1 is in the open position as shown in FIG. 1. The push pull sleeves 8 cooperate with the handrails 6 and act as a component of the activator mechanism in moving the housing box 1 to the closed position as shown in FIG. 2.

Figure 4:
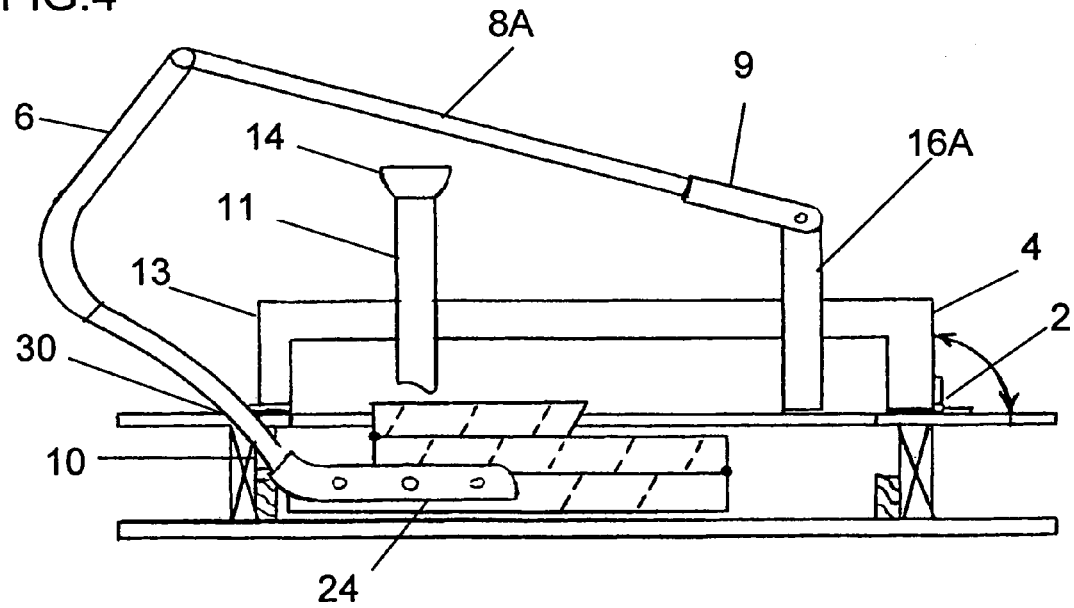
FIG. 4 is a side view of the activated hinged housing held in the closed position by the handrails and push pull rod attachments.

A riser 10 provides for passage and positioning of the arms 6 when the cover 1 is in the closed position. The handrail posts 11 in FIGS. 3 and 4 are fastened to the upper floor 5 by the post flanges 15 shown in FIG. 3. In FIG. 2, gasket or seal material 12 is attached under the arm catcher 30 and rear close stop 22 for reducing air and moisture infiltration into the upper room. The gasket material 12 in FIG. 3 is applied under the housing side panels 18 that meet the floor. In FIG. 1, the gasket material 12 is applied along the lower outside portion of the housing side panels 18 overlaying and sealing the outside of the runners 3. Sliding members 31 such as rollers, glides, or the like, appear in FIG. 2 and may be provided for reducing friction and thus the effort required to effect the sliding movement of the cover. Finally, the hinge 2 in FIG. 4 at the rear panel 4 of the housing 1 is used for the pivot location in raising the housing box 1.

The construction of the housing member consists of a preferably lightweight box, which may be made of durable wood, plastic, or other suitable material, and may be molded or monolithically formed, or may comprise panels bonded or fastened on its connecting edges. The arms 6 shown in FIGS. 1 and 3 may be made of a plastic, preferably a dimensionally stable plastic composite, wood, treated wood, metal or metal alloy such as steel, or the like. The push pull sleeves 8 and 8A include a channel or groove for receiving the handrail ends and may created, for example, from rigid tubing. Sleeves 8A may have an adjustment rod 9 for length. The handrail posts 11 may be fabricated from metal or metal alloy, wood, or plastic material with a receptacle 14 to accept the upper end of the arms 6. The height of handrail posts 11 and receptacle 14 is preferably adjustable. A flange 15 at the base of the post 11 is provided for securing the post to the upper floor 5.

In operation, the housing box 1 shown in FIGS. 1 and 3 moves away from the stairway opening 17 as the pull down stairway 7 is moved in the downward direction when deploying for use. Conversely, as the pull down stairway 7 is raised toward its stored position, the housing box 1 moves back into the closed position, thereby sealing the living space below from thermal loss, moisture loss, air convection and dust infiltration.

Previous solutions require manual intervention to remove a cover from the access opening and to return the cover to its proper position.

In operating the present invention, no change in the operating procedure of the pull down stairway 7 is required.

A method for installing the housing apparatus of the present is described below. It will be recognized that the cover system of the present invention may be installed on an existing pull down stairway installation, or, may readily adapted for use with a new pull down stairway construction. The runners 3 shown in FIG. 1 are fastened parallel to each other such that both runners are positioned equally on either side of the access opening 17 and aligned with the head of the stairway opening. With the stairway 7 in the down or open position as shown in FIGS. 1 and 3, the two arms 6 are fastened to the stair rails 20. With the stairway 7 in the closed position as shown in FIGS. 2 and 4, the riser 10 is fastened to the head of the stairway flush with the upper floor 5. The arms 6 may be adjusted for fit into the riser grooves and the fasteners that hold the lower portion of the arms 6 to the side rails 20 of the stairway 7 are tightened.

A boot 24 shown in FIGS. 2 and 4 is used to surround and clamp the lower portion of the arm 6 to the upper stairway rail 20 using bolt fasteners.

With the stairway fully open for the sliding configuration as shown in FIG. 1, the arms 6 are positioned into the sleeves 8. The cross member 32 is added between the two arms 6 and sleeve joints. The sleeves 8 are attached to the housing extension 16. The legs 25 which are attached to the arms 6 are adjusted to fit firmly onto the upper floor 5.

With the stairway fully open for the hinged configuration shown in FIG. 3, the handrail posts 11 are positioned onto the upper floor just below the upper ends of the deployed arms 6. The height of the post receptacles 14 at the top of the posts is adjusted to cradle the upper end of the activating arms 6. The posts 11 are fastened to the upper floor 5 with the post base flanges 15. The cross member 32A is added between the two arms 6 and sleeve joints. The sleeves 8A and adjustment rods 9 are attached to the housing extension 16A.

With the stairway 7 in the closed position, the housing box 1 with gasket seals 12 is fit over the access opening 17 with a snug fit around the head of the stairway 7, riser 10 and arms 6. For the sliding configuration in FIG. 2, the push pull sleeves 8 are attached to the arms 6. For the hinged configuration in FIG. 4, attach the sleeves 8A with push pull rods 9 to the extensions 16A. The length of the adjustment rods 9 is adjusted such that the front housing panel 13 fits snugly over the riser 10 at the head of the stairway with the arms 6 cradled in the notches at the top of the installed riser 10. For the hinged configuration, the hinge 2 is attached at the rear portion of the cover 1, as shown in FIG. 4. For the sliding configuration, the rear close stop 22 is attached as shown in FIG. 2. Insulation may be attached to the housing top 19, sides 18, front panel 13, and/or rear panel 4.

In operation, the two configurations shown in FIGS. 1 and 3 differ in the method of opening the stairway access 17.

For the sliding configuration shown in FIG. 1, the push pull sleeves 8 meet the housing extensions 16 attached to the sides 18 of the housing box 1. The adjustable extension brace 26 is attached to the housing extension 16 and the side 18 of the housing box 1. The extension brace 26 controls the position of the housing extension 16, the arms 6 and the housing 1. The extension brace 26 is adjusted with the housing box 1 in the closed position and the notches in the arm catcher 30 firmly around the arms 6 near the upper floor 5. With the adjustable braces 26 firmly in place, open the housing system and fasten the rear open stop 23 to the upper floor 5 as shown in FIG. 1.

Figure 5:
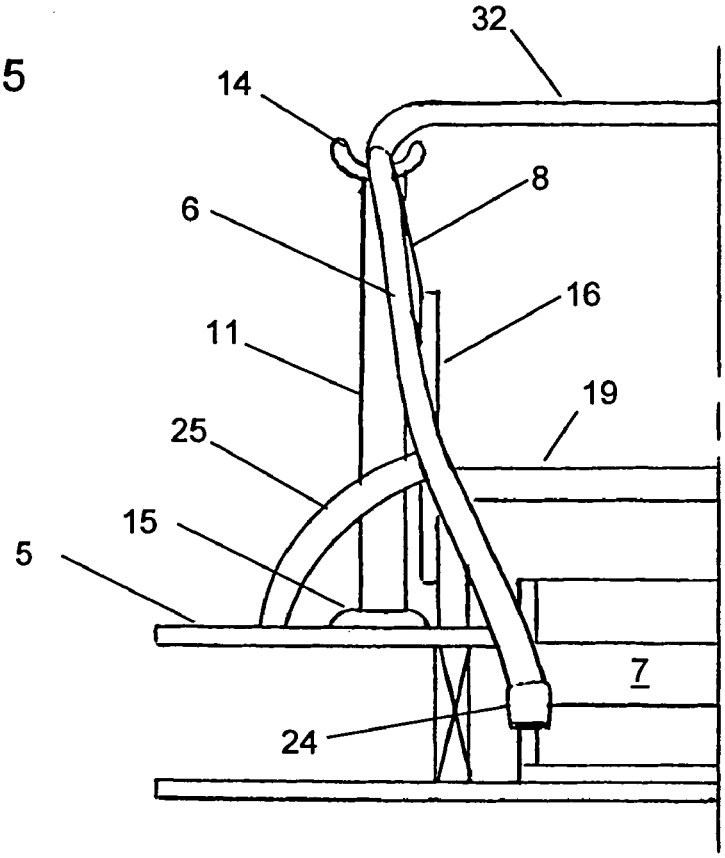
FIG. 5 is the left half cross-sectional view from the head of the folded stairway showing the activation apparatus of the integrated housing system in the closed position.
Figure 6:
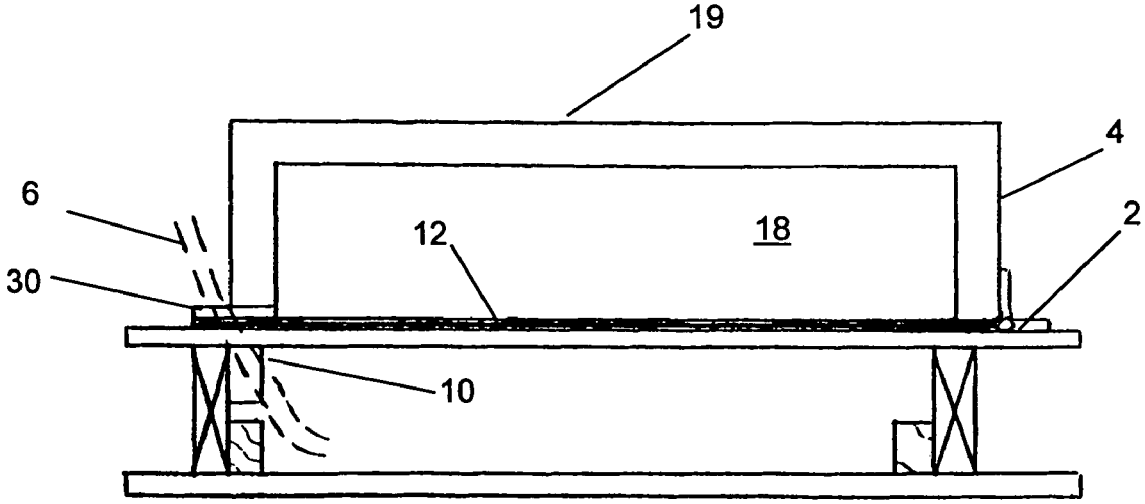
FIG. 6 shows the position of the air, moisture and dirt seal attached to the lower edge of the arm catcher and the sides and the back panels of the hinged popup housing configuration.

For the hinged configuration shown in FIG. 3, the push pull sleeves 8A and adjustment rods 9 are attached to the extensions 16A placed near the back of the housing sides 18 to give the proper moment arm force in relation to the hinge 2 location. The position and alignment of the apparatus in FIG. 5 involves the stairway 7, the arms 6, the push pull rods sleeves 8A, and the extension 16A. The hinged configuration demands less floor space, which may be an advantage in certain situations.

Optionally, the arms 6 may be constructed in two components for packaging and shipping. During installation, the arms are joined as shown in FIG. 1 and FIG. 3. Likewise, the runners 3 shown in FIG. 1 may, optionally, be constructed in multiple sections for packaging and shipping. During installation the runners 3 are joined into contiguous segments for guiding the housing box 1. Exemplary positions of the joint for the handrails 6 appear in FIGS. 1 and 3. Preferably the positions of the joints between the members are selected such that the parts will fit within the interior enclosure defined by the housing box 1. In this manner, the individual components for constructing the apparatus of the present invention may be provided disassembled or partially disassembled as a kit. In a preferred kit embodiment, the housing box or cover 1 serves as packaging container and/or shipping box for the kit.

The invention has been described with reference to the preferred embodiments. Modifications and alterations will occur to others upon a reading and understanding of the preceding disclosure herein, whereby it is to be distinctly understood that the foregoing descriptive matter is to be interpreted merely as illustrative of the invention and not as a limitation.

Having thus described the preferred embodiments, the invention is now claimed to be:

1. A housing system adapted to selectively cover an opening in a building floor accessible by a pull down stairway of a type pivotally movable between a stored position and a deployed position, said housing system comprising:

a cover movable between a first position covering the opening and a second position exposing the opening, said cover having an inverted construction defining an interior compartment for at least partially receiving the pull down stairway within said interior compartment when the housing system is installed to selectively cover the opening and the pull down stairway is in the closed position;

an actuator assembly connected to the cover and attachable to the pull down stairway, said actuator assembly causing movement of said cover from said first position to said second position in response to movement of the pull down stairway from the stored position to the deployed position when the housing system is installed to selectively cover the opening;

said actuator assembly having one or more handrail members, each of said one or more handrail members having a first end rigidly attached to the pull down stairway when the housing system is installed to selectively cover the opening and a second end pivotally linked to said cover; and said one or more handrail members movable in response to movement of the pull down stairway such that movement of the pull down stairway to the deployed position causes movement of said one or more handrail members to a position proximate and above the opening; the handrail being pivotally connected to the cover such that in a closed position the handrail extends above the cover.

2. The housing system of claim 1, wherein said one or more handrail members includes a pair of handrail members which are disposed on opposite transverse sides of the opening when the housing system is installed to selectively cover the opening.

3. The housing system of claim 1, wherein each of said one or more handrail members is coupled to an upper end of the pull down stairway when the housing system is installed to selectively cover the opening.

4. The housing system of claim 1, further comprising:

said actuator assembly including an articulated mechanical linkage coupling the second end of each of said one or more handrail members to said cover.

5. The housing system of claim 1, further comprising one or more stabilizers for stabilizing said one or more handrail members when the housing system is installed to selectively cover the opening and the pull down stairway is in the deployed position.

6. The housing system of claim 1, further comprising, for each of said one or more handrail members:

a housing extension rigidly attached to the cover; and a push pull sleeve pivotally attached at a first end to said housing extension and pivotally attached at a second end to a respective one of said one or more handrail members.

7. The housing system of claim 1, further comprising a sealing assembly for sealing said handrail members when the cover is in the first position, said sealing assembly including:

a riser fastened adjacent a forward portion of the opening in the building floor and flush with the building floor when the housing system is installed to selectively cover the opening; and a handrail member catcher attached to a lower portion of the cover in aligned relation to said one or more handrail members when the cover is in the first position.

8. The housing system of claim 7, further comprising:

a rear close stop fastened to the building floor adjacent a rearward portion of the opening in the building floor when the housing system is installed to selectively cover the opening;

a rear gasket seal attached to an interior portion of said cover and forming a sealing engagement between the cover and the rear close stop when the housing system is installed to selectively cover the opening and the cover is in the first position; and when the housing system is installed to selectively cover the opening, said rear close stop and said handrail member catcher positioned such that during operation, sealing between the handrail member catcher and the riser occurs simultaneously with sealing of the rear gasket seal against the rear close stop.

9. The housing system of claim 1, wherein said cover is insulated.

10. The housing of claim 1, further comprising a sealing member attached to said cover for reducing one or more of air, moisture, and dirt infiltration through the opening in the building floor when the cover is in the closed position.

11. The housing system of claim 1, wherein the cover is movable between said first and second positions via one of pivoting movement and sliding movement.

12. The housing of claim 11, wherein said cover is movable between said first and second positions via sliding movement and further comprising one or more of:

two runners fastened to the building floor adjacent the opening when the housing system is installed to selectively cover the opening and slidably engaging said cover;

a rear open stop fastened to the building floor at a position when the housing system is installed to selectively cover the opening such that opening motion stops at a predetermined position when the pull down stairway is moved to the deployed position; and one or more sliding members attached to said cover.

13. The housing system of claim 12, further comprising a gasket flap attached to said cover for sealing said runners.

14. The housing system of claim 11, wherein said cover is movable between said first and second positions via pivoting movement and further comprising one or both of:

one or more hinges pivotally attaching the cover to the floor when the housing system is installed to selectively cover the opening; and a gasket material about a peripheral edge of the cover for providing a sealing interference between the cover and the building floor when the cover is in the first position.

15. The housing system according to claim 1, further comprising an insulating material applied to the cover.

16. The housing system of claim 1, further comprising a pull down folding stair construction pivotally attached to the opening.

17. A housing system adapted to selectively cover an opening in a building floor accessible by a pull down stairway of a type pivotally movable between a stored position and a deployed position, said housing system comprising:

cover means for selectively covering the opening, said cover means movable between a first position covering the opening and a second position exposing the opening;

actuator means connected to the cover means for selectively moving the cover between the first and second positions in response to movement of the pull down stairway; and said actuator means having one or more handrail members, each of said one or more handrail members having a first end rigidly attached to the pull down stairway when the housing system is installed to selectively cover the opening and a second end pivotally linked to said cover means; and said one or more handrail members movable in response to movement of the pull down stairway such that movement of the pull down stairway to the deployed position causes movement of said one or more handrail members to a position proximate and above the opening; the handrail being pivotally connected to the cover such that in a closed position the handrail extends above the cover.

18. A kit having component parts capable of being packaged in a disassembled or partially disassembled form and of being assembled into a housing system adapted to selectively cover an opening in a building floor accessible by a pull down stairway of a type pivotally movable between a stored position and a deployed position, said kit comprising:

a cover movable between a first position covering the opening and a second position exposing the opening, said cover having an inverted construction defining an interior compartment and adapted to at least partially receive the pull down stairway within said interior compartment when the pull down stairway is in the closed position;

an actuator assembly attachable to said cover and the pull down stairway such that movement of the pull down stairway to the stored position causes said cover to move to said first position and movement of the pull down stairway to the deployed position causes said cover to move to said second position;

said actuator means having one or more handrail members, each of said one or more handrail members having a first end for rigid attachment to the pull down stairway and a second end for pivotally linking said one or more handrail members to said cover; and said one or more handrail members movable in response to movement of the pull down stairway such that movement of the pull down stairway to the deployed position causes movement of said one or more handrail members to a position proximate and above the opening; the handrail being pivotally connected to the cover such that in a closed position the handrail extends above the cover.

19. The kit of claim 18, further comprising:

said cover forming a packaging container for the component parts, whereby the component parts are received within said cover when the component parts are in the disassembled or partially disassembled form.

* * * * *